US006123226A

United States Patent [19]

Giattino et al.

[11] Patent Number: 6,123,226

[45] Date of Patent: Sep. 26, 2000

[54] BEVERAGE DISPENSING APPARATUS

[75] Inventors: Michael B. Giattino, Pembroke Pines, Fla.; Anthony Mileo, North Babylon, N.Y.

[73] Assignee: Liquid Dimensions International, Inc., Pembroke Pines, Fla.

[21] Appl. No.: 09/338,656

[22] Filed: Jun. 23, 1999

[51] Int. Cl.[7] ..... A41D 13/00

[52] U.S. Cl. ..... 222/2; 222/185.1; 222/144.5; 222/146.6

[58] Field of Search ..... 222/2, 129.1, 185.1, 222/144.5, 146.6; 194/13

[56] References Cited

U.S. PATENT DOCUMENTS

| | | | |
|---|---|---|---|
| 3,675,820 | 7/1972 | Newberry et al. | 222/76 |
| 3,709,408 | 1/1973 | Syverson | 222/129.4 |
| 4,059,181 | 11/1977 | Greenfield et al. | 194/13 |
| 4,681,244 | 7/1987 | Geddie | 222/144.5 |
| 5,913,454 | 6/1999 | McHale | 222/2 |

OTHER PUBLICATIONS

Photographs of Ice Block Design.

*Primary Examiner*—Kevin Shaver
*Assistant Examiner*—Melvin A. Cartagena
*Attorney, Agent, or Firm*—Reed Smith Shaw & McClay; Arthur Dresner

[57] ABSTRACT

The invention is directed to a beverage dispensing apparatus which has a housing including a beverage container storage section. At least one beverage container from which measured amounts of beverage will be dispensed is supported in the storage section. An inclined beverage conveying channel supported by the housing has a receiving end adapted for receiving a measured amount of beverage from at least one of the containers. The other end of the beverage conveying channel is located at a height lower than the receiving end so that beverage will flow by gravity toward the delivery end of the channel where a delivery spout is located for delivering the measured amount of the beverage into the mouth of a consumer. A beverage releasing mechanism is coupled to each container in the storage section for dispensing the measured amount of beverage onto receiving end of the inclined channel. A selector switch supported by the housing is electrically coupled to the beverage releasing mechanism for activating it when the selector switch is engaged. A coin changer device is also mounted on the housing and is connected to the selector switch by an electric circuit for activating the selector switch when a coin or appropriate token is deposited in the coin changer. A consumer can engage the selector switch when it is activated to activate the releasing mechanism in order to release a measured amount of beverage onto the receiving end of the inclined channel where it will flow down to the delivery end for consumption by the consumer.

16 Claims, 5 Drawing Sheets

BEVERAGE DISPENSING APPARATUS

FIELD OF THE INVENTION

The present invention relates generally to the field of devices for dispensing beverages and more particularly to an apparatus used to dispense measured amounts of alcoholic beverages or other spirits for delivery directly to the mouth of a consumer.

BACKGROUND OF THE INVENTION

This invention arises from the need to provide a mechanized and controlled apparatus to deliver measured amounts of alcoholic beverages directly to the mouth of a user. Heretofore, various types of apparatus have been proposed for use in restaurants, bar rooms, party rooms and similar environments to provide unique and pleasurable ways of serving and dispensing alcoholic beverages to consumers. One such arrangement has been to fashion a block of ice having an inclined surface with a groove formed in the inclined surface to allow for the gravity feed of alcoholic beverages from the upper end of the inclined surface downwardly along the groove to the lower end of the inclined surface where the groove will terminate and a consumer can place his mouth for receiving the flow of the alcoholic beverage. Such prior apparatus lacks any control over measuring the amount of beverage to be dispensed down the inclined groove. Further, this type of arrangement has no mechanism for monitoring the dispensing of such beverages, nor for the possibility of automatically generating revenue. In addition the prior arrangement which is fashioned from a block of ice has the significant disadvantage of melting and therefore of not being reusable.

OBJECTS OF THE INVENTION

It is accordingly a principle object of the present invention to provide a beverage dispensing apparatus of the type for delivering or dispensing beverages directly to the mouth of a consumer and which overcomes the disadvantages of the prior art.

A more particular object of the present invention is to provide such a dispensing apparatus which is reusable over long periods of time and which has the means for monitoring and controlling the dispensing of a measured amount of beverage to the consumer.

Another principal object of the present invention is to provide an apparatus for dispensing and delivering a measured amount of alcoholic beverage directly into the mouth of a consumer while having the means to generate revenue automatically through the use of a coin changer.

Another object of the invention is to provide an apparatus of the type described above for delivering a measured amount of alcoholic beverage or other beverage directly to a consumer and that is provided with means for supporting a plurality of beverage containers which hold different beverages that can be dispensed to the consumer upon activation of a selector switch.

Other features, objects and advantages of the present invention will become apparent from the description below.

BRIEF SUMMARY

This invention relates to a beverage dispensing apparatus which has a housing that includes a beverage container storage section. The beverage container storage section includes structure for supporting at least one beverage container, and preferably at least three such containers from which measured amounts of beverage will be dispensed. An inclined beverage conveying channel, which is supported by the housing, has a receiving end engaged with the storage section which supports the beverage containers. The receiving end of the channel is adapted for receiving a measured amount of beverage from a selected one of the containers. The other or delivery end of the beverage conveying channel is positioned at a height lower than the receiving end so that beverage which is received at the receiving end of the channel will flow by the force of gravity toward the delivery end of the channel where it can be delivered directly into the mouth of a consumer. A delivery spout is located at the delivery end of the channel for delivering the measured amount of the beverage into the mouth of the consumer. A beverage releasing mechanism is coupled to each of the containers in the storage section for releasing the desired pre-measured amount of beverage from the selected container onto the receiving end of the inclined channel when the release mechanism is activated. A selector switch is supported by the housing and is electrically connected to each beverage releasing mechanism for activating a selected release mechanism when the selector switch is moved to a selected position. A coin changer device is also mounted in the housing and is connected to the selector switch by an electric circuit which includes means for activating the selector switch when a coin or appropriate token is deposited in the coin changer. Upon deposit of an appropriate coin and activation of the selection switch a consumer can move the switch to a selected position for thus activating a selected releasing mechanism to release a measured amount of beverage from the beverage container coupled to that mechanism onto the receiving end of the inclined channel where it will flow down to the delivery end for consumption by a consumer.

The foregoing and other features of the present invention are more fully described with reference to the following drawings annexed hereto.

DESCRIPTION OF THE PREFERRED EMBODIMENTS

Figure 1:
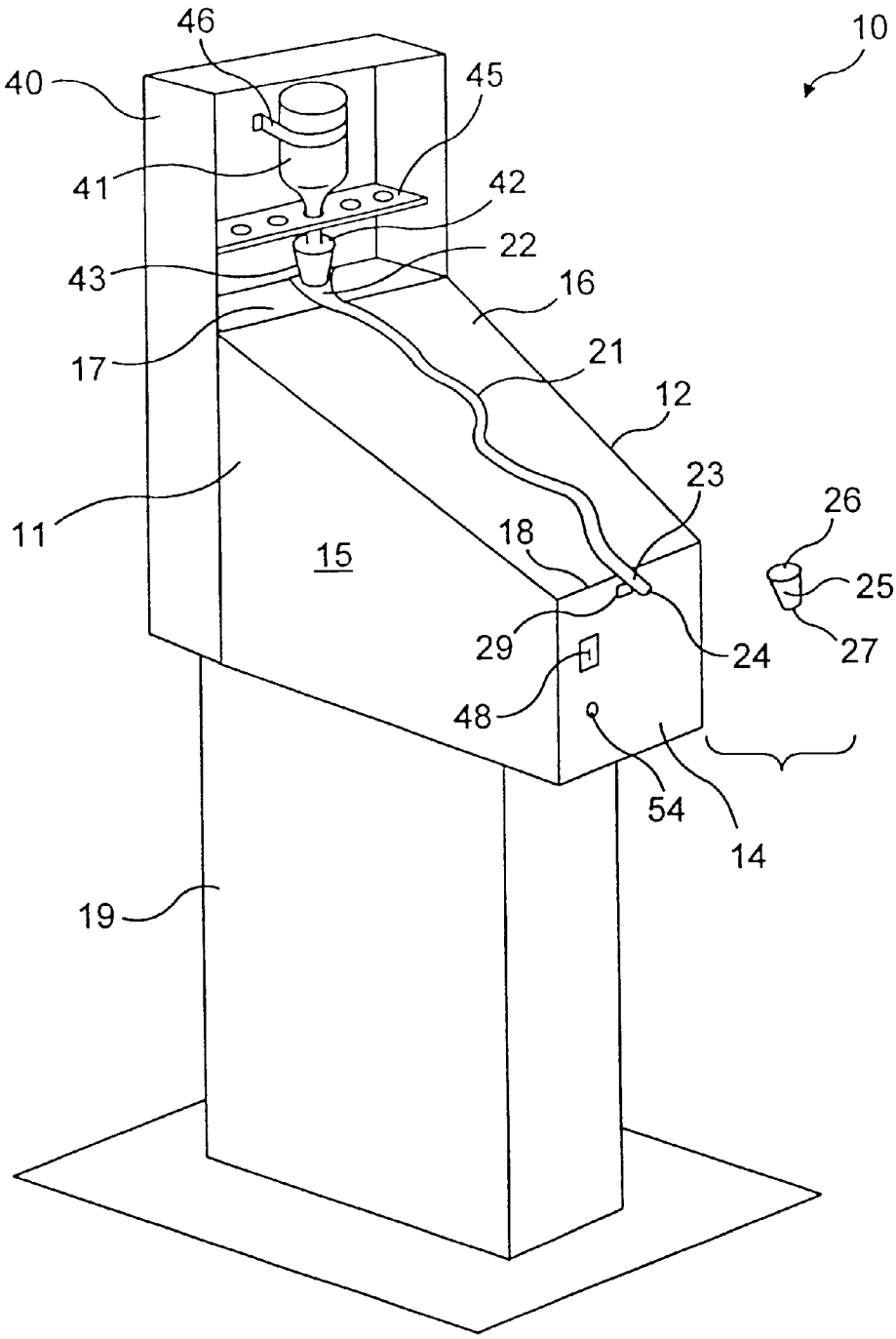
FIG. 1 is a perspective view illustrating one embodiment of the present invention.

Referring now to the drawings and with particular reference to FIG. 1, reference numeral 10 denotes the beverage dispensing apparatus of the present invention for delivering a measured amount of beverage directly to a consumer's mouth. The dispensing apparatus 10 is formed by a housing 11 having a beverage delivery section 12 and a beverage container storage section 40. The housing 11 can be supported on a base or stand 19 for convenient use, or it may be placed directly on a table or a bar. The delivery section 12 of the housing 11 has a front end 14, side walls 15 (only one of which is visible in FIG. 1), a back end which is contiguous with the storage section 40 and a top inclined surface 16. A beverage conveying channel 21 is formed on the inclined surface 16. The inclined surface 16 has a receiving end 17 and a delivery end 18. The receiving end 17 is at a position higher than the delivery end 18. Channel 21 also has a receiving end 22 located at the receiving end 17 of the surface 16 and a delivery end 23 at the delivery end 18 of surface 16 so that beverage received at end 22 of channel 21 will flow by gravity from the receiving end 22 down to the delivery end 23. Channel 21 terminates at the delivery end 23 in a spout 24. Beverage which flows down the channel 21 from the receiving end 22 to the spout 24 can be delivered at the spout directly into the mouth of a consumer or into a personalized mouthpiece 25 in the form of a funnel having a receiving opening 26 which can be placed onto the spout 24, and a delivery end 27 which can be placed into the mouth of a consumer. The use of the mouthpiece 25 will avoid unsanitary situations where multiple users might place their mouths directly on the spout 24. A switch, such as a limit switch 29, can be located on the spout 24 so that no beverage can be dispensed without a sanitary mouthpiece 25 in place on the spout.

In the embodiment illustrated in FIG. 1 beverage container storage section 40 contains a single beverage container 41, which in the embodiment illustrated is a bottle of alcoholic spirits, supported by rack 45 and bracket 46 in an inverted position with the open end 42 of the bottle directed downwardly. A releasing mechanism 43 is connected to the open end 42 of bottle 41 for releasing a measured predetermined amount of beverage from the bottle 41 onto the receiving end 22 of the channel 21 so that it may flow down the channel 21 to the spout 24. Mechanism 43 is of a commercially available type, such as the MeasureMate produced by Precision Measures Limited of Melbourne Australia. This device will release a predetermined measured volume of beverage from bottle 41 when it is actuated or opened by an electrical signal. Such a signal is generated by closing a circuit illustrated in FIG. 2 to a source of electrical power 49 by engaging a selector switch 44, which has an activation button 54 located on the front end 14 of housing 11. Switch 44, however, can not be used to close the circuit of mechanism 43 with power supply 49 unless a coin of an appropriate denomination or a token (which can be purchased) of a particular size or shape so that it can be unique for this application, is entered into a coin changer 47, the entry slot 48 of which is positioned on the front end 14.

Figure 2:
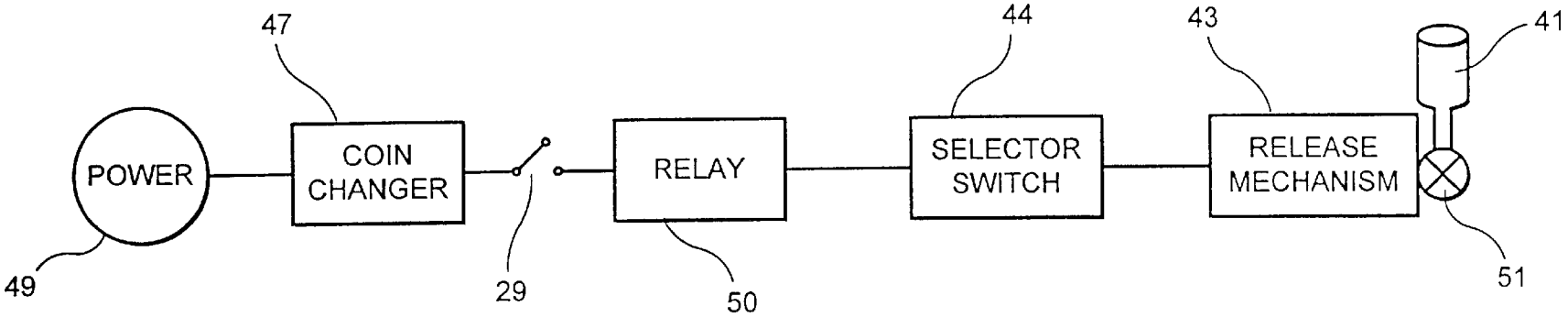
FIG. 2 is a block schematic diagram illustrating functioning elements for operation of the embodiment illustrated in FIG. 1.

FIG. 2 is a block schematic diagram illustrating the circuitry for activating mechanism 43. Coin changer 47 is connected through limit switch 29 to power supply 49 for energizing relay 50. When a coin or token of a proper denomination or dimension is deposited into the coin changer 47, relay 50 will close establishing electrical communication between power supply 49 and selector switch 44. When switch 44 is thus activated it can be closed by pressing button 54 so that dispensing mechanism 43 can receive the appropriate amount of electrical energy in order to open a valve 51 contained within the mechanism 43 in order to release the pre-measured amount of beverage from bottle 41. Pressing button 54 also releases or opens relay 50 so that dispensing mechanism 43 can only be activated once to release a single predetermined measured quantity of beverage. If a consumer wants to receive a second measured amount of beverage, he or she will have to deposit another coin or token into coin changer 47 to once again close relay 50.

The embodiment illustrated and described in connection to FIGS. 1 and 2 relates to an apparatus having only a single beverage container 41 in storage area 40 from which beverage will be dispensed into the channel 21. However, a plurality of beverage containers can be stored in the storage area 40. This embodiment is illustrated in FIGS. 3 and 4.

Figure 3:
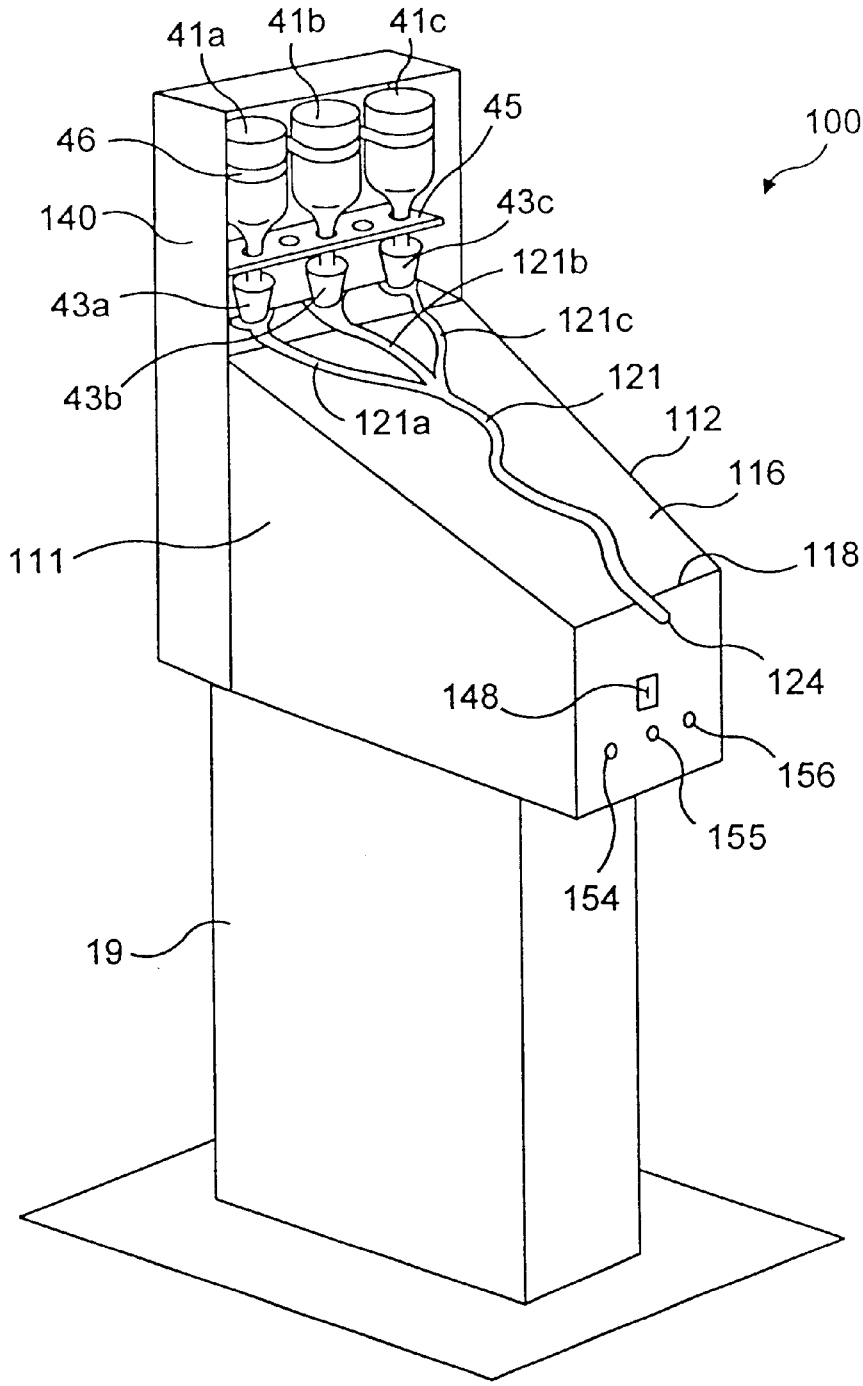
FIG. 3 is a perspective view similar to that shown in FIG. 1 illustrating another embodiment.

FIG. 3 shows dispensing apparatus 100 constructed in a fashion similar to that illustrated in FIG. 1. In this embodiment housing 11 has a beverage delivery section 112 and a beverage storage section 140. Three beverage containers 41*a*, 41*b* and 41*c* are supported on a rack 45 and brackets 46. It will be appreciated that any number of containers can be supported in the storage section. Each of the containers 41*a*, 41*b* and 41*c* are supported in an inverted position with their open ends directed downwardly. Each container has a releasing mechanism 43*a*, 43*b* and 43*c* respectively connected to the open end of the beverage containers. Inclined surface 116 has beverage conveying channel 121 with three branches 121*a*, 121*b* and 121*c* for receiving released beverage from releasing mechanisms 43*a*, 43*b* and 43*c* respectively. Channel 121 terminates at the delivery end 118 of inclined surface 116 in a spout 124 for delivering beverage directly into the mouth of a consumer or into a mouthpiece, such as mouthpiece 25 described in connection with FIG. 1. Activating release mechanisms 43*a*, 43*b* or 43*c* is controlled by the circuitry illustrated in FIG. 3 and described below. In this embodiment a coin changer having a slot 148 for receiving a coin or token will activate a selector switches 54*a*, 54*b* and 54*c* which have activation buttons 154, 155 and 156 respectively for activating a selected release mechanisms 43*a*, 43*b* or 43*c* respectively.

Figure 4:
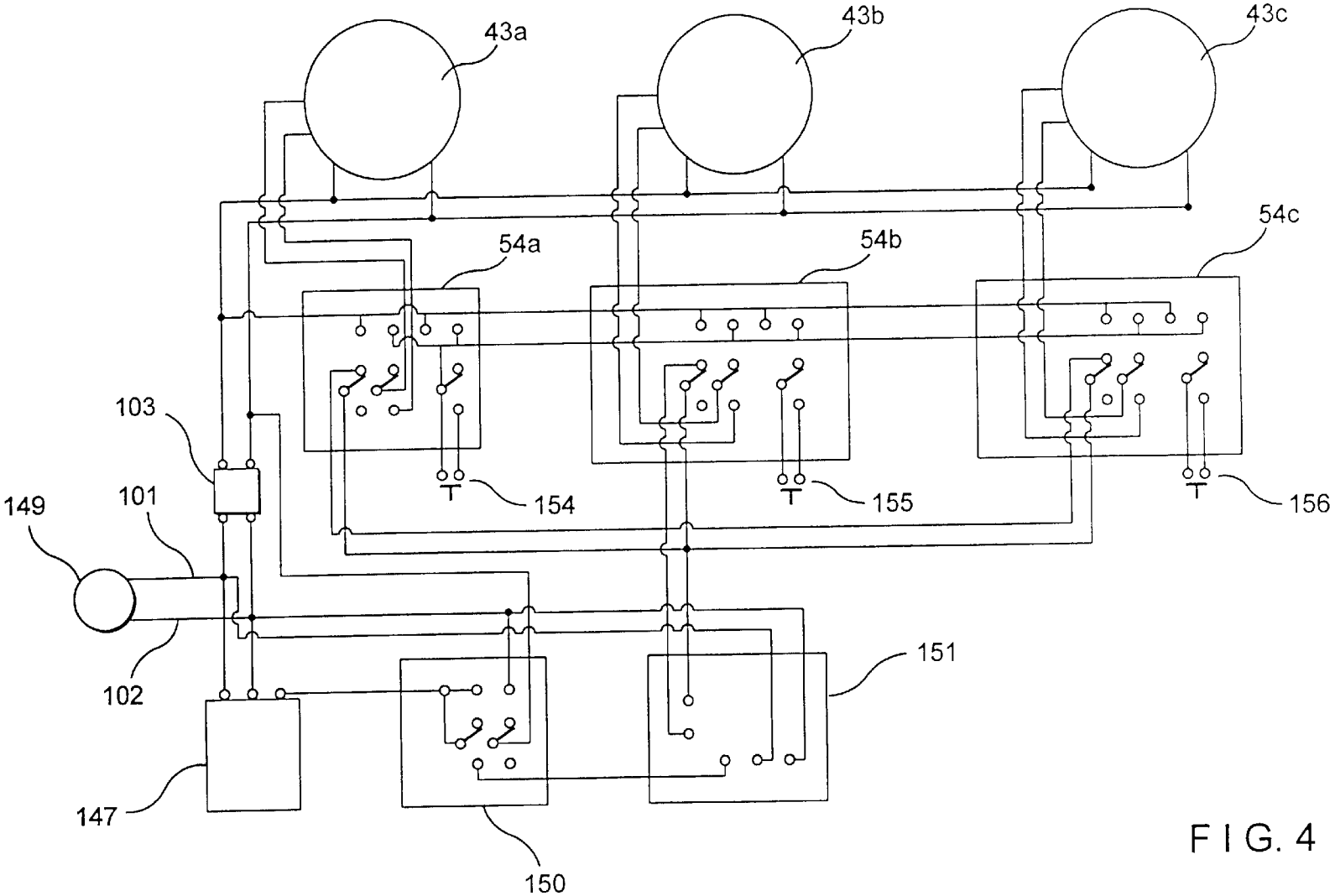
FIG. 4 is a schematic diagram illustrating functioning elements according to the embodiment shown in FIG. 3.

Referring now to FIG. 4, lines 101 and 102 are connected to a source 149 of 110 volt AC power. A coin changer 147, such as the commercially available MARS unit number 6800H is activated when an appropriate coin is deposited into the coin changer through slot 148. Coin changer 147 is connected to a 110 volt relay 150, such as from the Siemens company model K10P-11A15–120. Relay 150 is connected to time delay relay 151 such as Dayton model number 6A857. A stepdown transformer 103 provides 24 volt power for activating dispenser mechanisms 43*a*, 43*b* or 43*c* when power is brought to the appropriate dispenser through selector switches 54*a*, 54*b* or 54*c* respectively by depressing push buttons 154, 155 or 156 respectively. As will be appreciated, depressing one of the push buttons 154, 155 or 156 will provide an appropriate electrical circuit to one of the releasing mechanisms 43*a*, 43*b* or 43*c* respectively when the respective selector switch has been activated by the establishment of a circuit through coin changer 147 and closing relay 150, which will occur upon the deposit of an appropriate coin. Upon the activation of a selected releasing mechanism, a measured amount of beverage from either container 41*a*, 41*b* or 41*c* will be released onto a respective branch 121*a*, 121*b* or 121*c* where it will flow by gravity into the main channel 121 and then by gravity to the delivery end 118 of the inclined surface 116 to spout 124 where it can be consumed directly by the consumer. Depressing one of the buttons also opens relay 150. If a consumer desires to receive beverage from more than one of the containers, another coin or token will have to be deposited. Depressing more than one of the buttons 154, 155 or 156 after depositing more coins will result in activating the respective releasing mechanism simultaneously so it is possible to release beverage from more than just one of the bottles 41*a*, 41*b* or 41*c*. The multiple released beverages will flow down its respective branch channel 121*a*, 121*b* and 121*c* and will ultimately blend together where the branch channels meet the main channel 121.

An alternative to the use of electrically operated release mechanism 43*a*, 43*b* or 43*c* beverage from the containers within the storage section 40 can be released manually into the receiving channel into the respective branch channel 121*a*, 121*b* or 121*c* such as through the use of a mechanical lever arrangement attached to the open end of the bottle.

Other variations relate to the design of the inclined surface 116 and channel 121 with its branches 121*a*, 121*b* and 121*c*. Those skilled in the art will appreciate that numerous designs can be implemented in lieu of the plain surface 116 and channels depicted herein.

Figure 5:
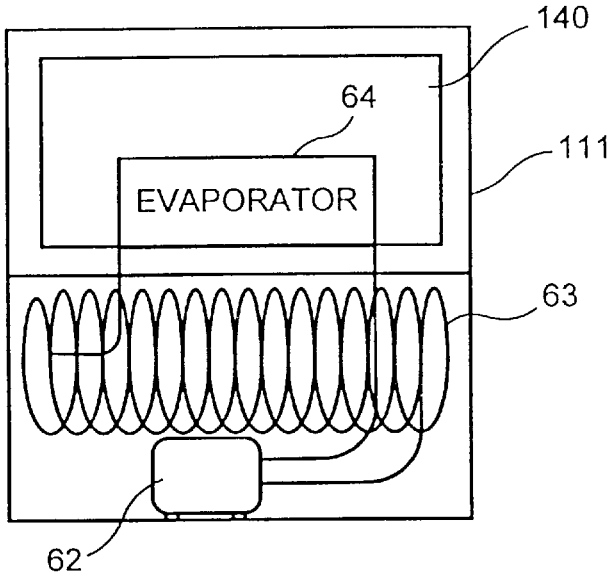
FIG. 5 is a rear elevational view of the apparatus according to the present invention.
Figure 6:
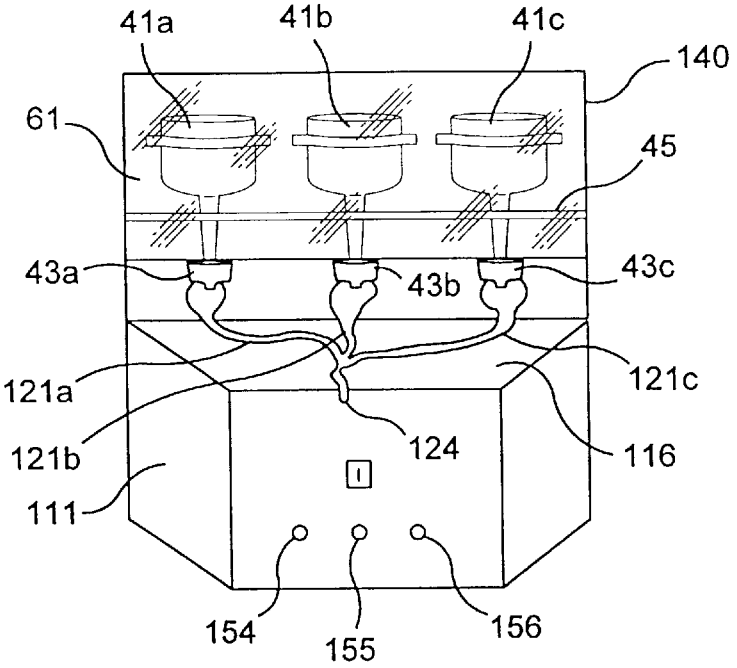
FIG. 6 is a front elevational view of the invention illustrated in FIG. 3.

A further feature of the invention is to provide for the storage section 40 to be cooled or refrigerated so that the beverage containers supported within the section 40 will be appropriately chilled. Compressor 62 illustrated in the rear view of housing 111 shown in FIG. 5 is connected to cooling coils 63 which in turn are connected to evaporator 64. Evaporator 64 is located within the storage section 140 for providing cooling to the area in section 140 in which beverage containers 41 are supported on rack 45. An insulated glass covering 61 can be placed over the front of storage section 140 as illustrated in FIG. 6 in order to retain the cooled air in section 140. In this manner, the measured amount of beverage to be released into the channel of the inclined surface 116 will be appropriately chilled for consumption.

Channel 121 and its branches 121*a*, 121*b* and 121*c* may be integrally formed with the inclined surface 116 or may be a separate structure. In either case the material from which these channels are to be constructed are of course to be FDA approved since it will be conveying beverages to be consumed by humans.

The invention has been described and illustrated in connection with certain embodiments which illustrate the principals of the invention. However, it should be understood that various modifications and changes may readily occur to those skilled in the art, and it is not intended to limit the invention to the embodiments shown and described herein. Accordingly, additional modifications and equivalence may be considered as falling within the scope of the invention as described by the claims herein below.

What is claimed is:

1. A beverage dispensing apparatus comprising:

a housing having a beverage container storage section for supporting therein at least one beverage container from which measured amounts of beverage will be dispensed;

an inclined beverage conveying channel supported by said housing having a beverage receiving end engaged with said storage section for receiving said measured amount of beverage, and a beverage delivery end located at a height lower than said receiving end so that dispensed beverage received at said receiving end of said channel will flow by gravity from such receiving end to said delivery end;

a delivery spout located at said delivery end of said channel for delivering said measured amount of said beverage into the mouth of a consumer;

a beverage releasing mechanism coupled to said at least one beverage container for dispensing said measured amount of beverage onto said receiving end of said channel when said mechanism is activated; and a selector switch supported by said housing and electrically coupled to said beverage releasing mechanism for activating said releasing mechanism when said selector switch is engaged.

2. The beverage dispensing apparatus according to claim 1 further comprising a switch mechanism for engaging said selector switch.

3. The beverage dispensing apparatus according to claim 2 wherein said switch mechanism is a button switch.

4. The beverage dispensing apparatus according to claim 3 further comprising means for activating said selector switch.

5. The beverage dispensing apparatus according to claim 4 wherein said means for activating said selector switch is a coin changer mounted on said housing, a relay electrically connected to said coin changer and to said selector switch for activating said selector switch, said coin changer adapted to receive a coin of a specific denomination or dimension, whereby when said coin is received by said coin chenger an electric circuit will be established with said selector switch so that said beverage releasing mechanism can be activated to dispense said measured amount of beverage onto said receiving end of said channel.

6. The beverage dispensing apparatus according to claim 5 wherein said relay will open upon activating said releasing mechanism thereby deactivating said selector switch until a coin is again deposited in said coin changer.

7. The beverage dispensing apparatus according to claim 6 further comprising a sanitary mouthpiece adapted to be held onto said spout for use by a consumer.

8. The beverage dispensing apparatus according to claim 7 further comprising means for preventing activation of said releasing mechanism if said mouthpiece is not held on said spout.

9. The beverage dispensing apparatus according to claim 8 wherein said means for preventing activation of said releasing mechanism is a limit switch.

10. A beverage dispensing apparatus comprising a housing having a storage section for supporting a plurality of beverage bottles from which measured amounts of beverage are to be dispensed; an inclined surface carried by said housing having a first end thereof engaged with said storage section and a second end thereof located at a height lower than said first end, a beverage conveying branch channel located on said inclined surface for each of said beverage bottles to receive therein a measured amount of beverage to be dispensed, said branch channels merging into a main channel in said inclined surface terminating at a spout located at said second end of said inclined surface for delivering said measured amount of beverage into the mouth of a consumer; a beverage releasing mechanism coupled with each of said beverage bottles for releasing a measured amount of beverage from each said bottle to its respective branch channel when said mechanism is activated, selector switch means supported by said housing for activating a selected releasing mechanism when said selector switch means is engaged; and a coin changer mounted on said housing and connected to said selector switch by an electric circuit for activating said selector switch to permit selection of a dispensing mechanism.

11. The beverage dispensing apparatus according to claim 10 wherein said coin changer closes a circuit between said selector switch and said plurality of releasing mechanisms for each of said beverage bottles to permit said selector switch to activate said releasing mechanism.

12. The beverage dispensing apparatus according to claim 11 further comprising relay means electrically connected to said coin changer for preventing activation of any of said selector switches until a coin is deposited in said coin changer.

13. The beverage dispensing apparatus according to claim 12 wherein said releasing mechanism includes a valve which is opened and closed by said releasing mechanism upon said selector switch being closed.

14. The beverage dispensing apparatus according to claim 13 further comprising a removable mouthpiece for engaging said spout for use by a consumer to receive beverage dispensed by said apparatus.

15. The beverage dispensing apparatus according to claim 13 further comprising means for cooling said beverage bottles within said storage section.

16. The beverage dispensing apparatus according to claim 15 wherein said means for cooling said beverage bottles comprises said refrigerator apparatus including a compressor carried by said housing, cooling coils connected to said compressor and an evaporator connected to said cooling coils located within said storage area.

* * * * *